US007984766B2

(12) United States Patent
Brown et al.

(10) Patent No.: US 7,984,766 B2
(45) Date of Patent: Jul. 26, 2011

(54) SYSTEM, METHOD AND APPARATUS FOR GAS EXTRACTION DEVICE FOR DOWN HOLE OILFIELD APPLICATIONS

(75) Inventors: Donn J. Brown, Broken Arrow, OK (US); B. Lyle Wilson, Tulsa, OK (US); Earl B. Brookbank, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 356 days.

(21) Appl. No.: 12/261,104

(22) Filed: Oct. 30, 2008

(65) Prior Publication Data

US 2010/0108307 A1 May 6, 2010

(51) Int. Cl.
*E21B 43/00* (2006.01)
*E21B 43/38* (2006.01)

(52) U.S. Cl. ..... 166/372; 166/105.5; 417/423.3

(58) Field of Classification Search ..... 166/105.5, 166/369, 372; 417/151, 423.3
See application file for complete search history.

(56) References Cited

U.S. PATENT DOCUMENTS

| | | | | |
|---|---|---|---|---|
| 2,814,992 | A | 12/1957 | Humason | |
| 2,845,028 | A | 7/1958 | Nash et al. | |
| 4,294,573 | A | 10/1981 | Erickson et al. | |
| 4,381,175 | A | 4/1983 | Erickson | |
| 6,026,904 | A * | 2/2000 | Burd et al. | 166/313 |
| 6,079,491 | A | 6/2000 | Stuebinger et al. | |
| 6,112,816 | A * | 9/2000 | Orzechowski et al. | 166/324 |
| 6,168,388 | B1 | 1/2001 | Hughes et al. | |
| 6,357,530 | B1 | 3/2002 | Kennedy et al. | |
| 6,394,183 | B1 | 5/2002 | Schrenkel et al. | |
| 6,422,317 | B1 * | 7/2002 | Williamson, Jr. | 166/374 |
| 6,497,287 | B1 | 12/2002 | Podio et al. | |
| 6,698,521 | B2 | 3/2004 | Schrenkel et al. | |
| 6,705,403 | B2 | 3/2004 | Podio et al. | |
| 7,063,161 | B2 | 6/2006 | Butler et al. | |
| 7,086,294 | B2 * | 8/2006 | DeLong | 73/861.63 |
| 7,210,532 | B2 | 5/2007 | Sherwood et al. | |
| 7,556,102 | B2 * | 7/2009 | Gomez | 166/373 |
| 7,686,078 | B2 * | 3/2010 | Khomynets | 166/254.2 |
| 2006/0196674 | A1 | 9/2006 | Butler et al. | |
| 2007/0175641 | A1 | 8/2007 | Sherwood et al. | |
| 2007/0231158 | A1 | 10/2007 | Butler et al. | |
| 2009/0016900 | A1 * | 1/2009 | Khomynets | 417/172 |
| 2010/0096141 | A1 * | 4/2010 | Brown et al. | 166/369 |

FOREIGN PATENT DOCUMENTS

SU 1682535 A1 * 10/1991

* cited by examiner

*Primary Examiner* — Daniel P Stephenson
(74) *Attorney, Agent, or Firm* — Bracewell & Giuliani LLP

(57) ABSTRACT

A gas extraction device for down hole oilfield applications utilizes the flow of the liquid, created by an artificial lift device, to produce conditions by which the gas is drawn into tubing. A venturi creates a low pressure area through a constricted section of the tubing. The pressure within the throat of the venturi drops the pressure in the casing. The device is axially adjusted to allow communication ports to a lower pressure area of the casing annulus. The lower pressure in the venturi draws the gas into the liquid stream and into the production tubing above the device. The gas is then transferred through the well head within the liquid stream.

19 Claims, 7 Drawing Sheets

SYSTEM, METHOD AND APPARATUS FOR GAS EXTRACTION DEVICE FOR DOWN HOLE OILFIELD APPLICATIONS

BACKGROUND OF THE INVENTION

1. Technical Field

The present invention relates in general to gas extraction in oilfield applications and, in particular, to an improved system, method and apparatus for a gas extraction device for down hole oilfield applications.

2. Description of the Related Art

The separation of gasses and liquids carried out in a well bore is common. The separation of gasses and liquids at the seabed as part of a subsea oilfield exploitation is becoming increasingly common. Separating the gas and using a high head centrifugal pump to pump the liquids vastly improves the project economics (e.g., asset net present value and recovery factor). The separation of the gas from the liquid also results in improved flow assurance. Moreover, pumping fluids that contain excessive amounts of gas can cause gas lock in a pump or can cause a pump to overheat and fail prematurely.

Currently, in a well bore, the accepted method of controlling the gas-liquid interface level is to manually control the amount of fluid produced by artificial lift, such as a down hole electric submersible pump (ESP). Generally, the ESP is installed and the production rate is set. If the pump encounters a gas lock condition, it is shut down to allow the well to recover, restarted and a new lower production rate is manually set. This is continued until the ESP is operating in a continuous and stable manner. Conversely, if the pump does not gas lock when the ESP is first installed and is operating in a stable manner, the production rate is manually increased in steps until a gas lock condition occurs. After recovery, the production rate is then reduced to the point of the last stable operation. The object is to produce the maximum fluid available from the well with the pumping equipment.

In such ESP applications, the liquid travels through production tubing to the surface. Excess gas gathers at the top of the well within the casing and is typically vented at the well head to a separate gathering system. Alternatively, the gas is connected into the liquid production line down stream of the wellhead. In some cases, however, production would benefit from gas entering the liquid production stream down hole within the well casing.

SUMMARY OF THE INVENTION

Embodiments of a system, method, and apparatus for a gas extraction device for down hole oilfield applications are disclosed. The invention utilizes the flow of the liquid, created by an artificial lift device, to produce conditions by which the gas is drawn into tubing. A venturi creates a low pressure area through a constricted section of the tubing. The pressure within the throat of the venturi drops lower than the pressure in the casing. The device may be axially adjusted to allow communication ports to a lower pressure area of the casing annulus. The lower pressure in the venturi draws the gas into the liquid stream and into the production tubing above the device. The gas is then transferred through the well head within the liquid stream.

The venturi may be located near the pump exit; however it may not be able to generate a pressure that is sufficiently low enough to entrain the gas. As the fluid is withdrawn from the well, the fluid level drops. This lowering of the gas-liquid interface in the well increases the gas pressure in the upper regions of the casing. The venturi may be located high enough in the well so that the pressure balances allow the venturi to evacuate the gas from the casing annulus. As the gas enters the flowing liquid in the tubing it lightens the liquid and begins to add buoyancy to the vertical flow forces. This reduces the burden on the pump and increases its performance. The venturi may be located low enough, however, to take advantage of the lift assist from the gas and high enough to allow the pressure balance in the venturi to create the evacuation of the gas from the casing. The invention may be used in sub-surface well applications, and may be especially useful in subsea applications where a second line to remove the gas from the bottom hole pumping system or well is not an option.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

Figure 1:
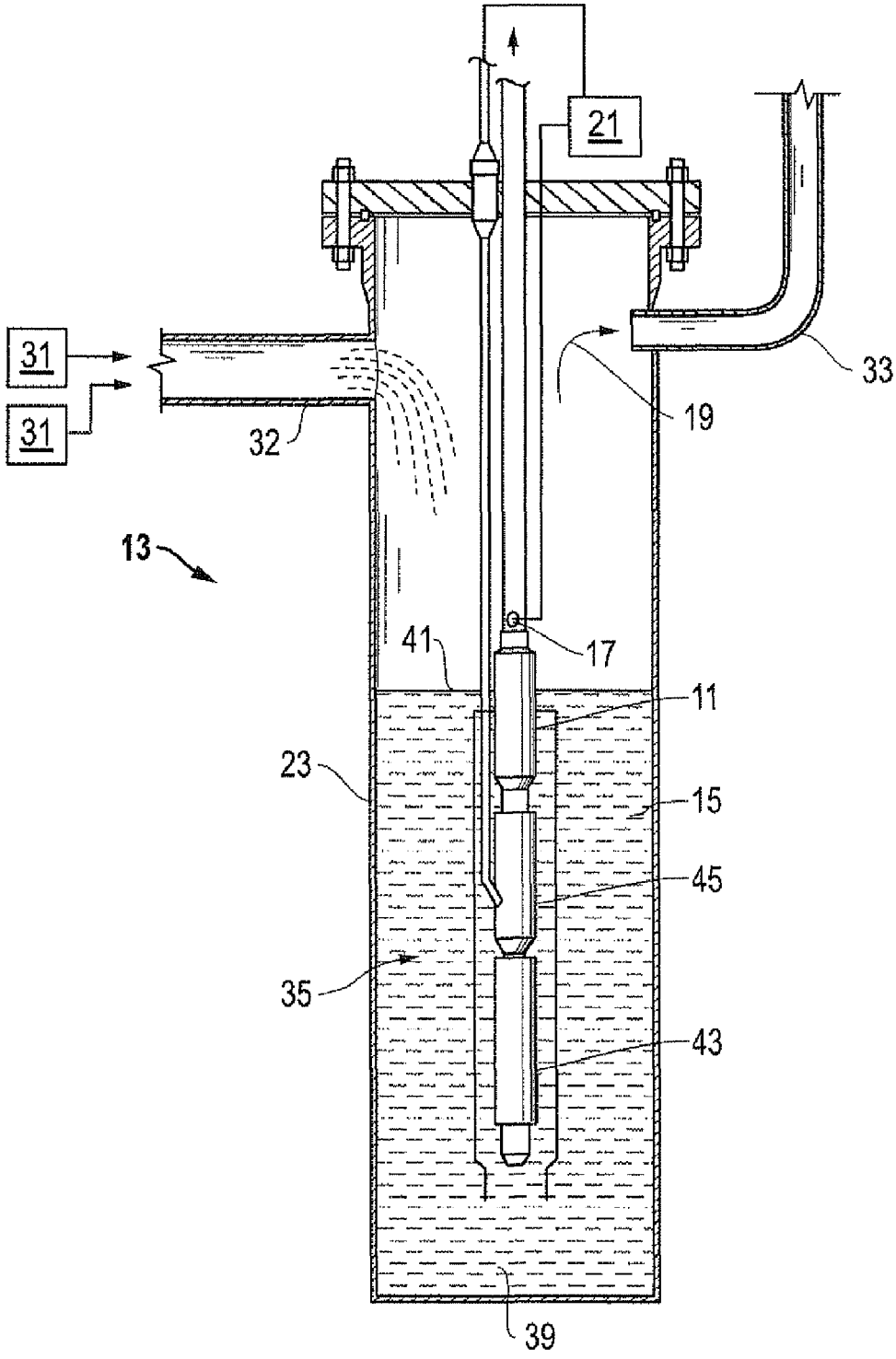
FIG. 1 is a schematic diagram of one embodiment of an electrical submersible pump (ESP) assembly for a production system and is constructed in accordance with the invention.

Referring to FIGS. 1-9, embodiments of a system, method and apparatus for a gas extraction device for down hole oilfield applications are disclosed. The system may include an electrical submersible pump (ESP) assembly having, e.g., a centrifugal pump, a sucker rod pump, a hydraulic pump, or any kind of pump as well as an ESP. The ESP pumps a gassy fluid in a well or production vessel with the intake flow to the pump routed in such a way that the gas substantially separates from the oil and is not drawn into the pump. Systems are provided to remove the gas to gas processing facilities located at the surface.

In a basic embodiment (FIG. 1), the invention comprises a system for controlling a pump 11 in a well or other type of gas-oil separation and production environment, such as a production vessel 23 (e.g., a caisson, canned pump assembly, booster pump assembly, etc.). The production vessel 23 is the sealed vessel that contains the oil and gas to be pumped to the surface. The system uses the pump 11 to retrieve fluid 15 from the production vessel 23.

One or more instruments or sensors 17 are located adjacent the pump 11 to obtain physical property measurements of the fluid 15. Physical properties such as density, capacitance, etc., that are influenced by the presence of a gas are suitable for these applications. For example, the rotational speed of a turbine flow meter is directly proportional to the gas content in fluid. Although the sensor 17 is shown located at the fluid discharge area (e.g., after gas separation) of the pump, it also may be located at a fluid intake area relative to the pump, or at other positions along the assembly. In addition, the sensor 17 may comprise a plurality of sensors located at different positions along the fluid flow path relative to the assembly.

In one embodiment, density measurements may be used as an indicator of the relative proportion of gas 19 in the fluid 15. A controller 21 coupled to the sensor 17 controls the components of the system. The production values of the system may be modified responsive to the desired properties of the fluids in order to maintain a desired constant or set point level of gas within the production vessel 23. The desired level of gas within the vessel may be selected based on many criteria and depends on the application. For example, in one embodiment, the set point level may be established at or near the pump intake to provide the maximum gas volume and the maximum gas liquid separation prior to producing the fluid to the surface.

As shown in the embodiment of FIG. 1, the invention is employed in an oil and gas production system comprising a plurality of wells 31 for producing oil and gas. The production vessel 23 may be provided with an inlet pipe 32 for fluid communication with the plurality of wells 31. The production vessel 23 contains a volume of oil 15 and a volume of gas 19 produced by the plurality of wells. The production vessel 23 may be provided with a gas port 33 for releasing the gas 19.

The ESP assembly 35 is installed in the production vessel 23 for pumping oil 15 out of the production vessel 23. The lower end of the ESP assembly 35 is submerged beneath an interface 41 between the volumes of oil 15 and gas 19. In the embodiment shown, the ESP assembly 35 comprises a motor 43, a seal section 45 and the pump 11, and may include a gas separator. The sensor 17 measures a property (e.g., density) of the fluid processed by the ESP assembly 35. The controller 21 controls the flow rate and other variables of pump 11 in response to the sensor 17.

As described herein, the flow rate of the pump 11 may be modified responsive to the fluid density measurements to maintain a desired level 41 of gas within the production vessel 23. The fluid density indicates a relative proportion of gas in the oil. The sensor 17 may be located at the fluid discharge or fluid intake areas relative to the pump. In alternate embodiments, the sensor 17 may comprise multiple sensors located at different positions along a fluid flow path relative to the ESP assembly 35. Such sensors may sense or measure more than one property of the fluid. The automated flow rate control of the pump may be manipulated by, e.g., modifying the speed of the pump. Alternatively, a choke (e.g., discharge choke valve) may be provided in the fluid flow path downstream from the pump to regulate the flow rate of fluid through the pump.

Referring now to FIGS. 2-6, the fluid production system also comprises a gas extraction device 51 (or "jet pump") that is located above the ESP assembly 35. The gas extraction device 51 is adjacent or may be mounted directly to the ESP assembly 35. The gas extraction device has a body 53 with an axis 55 and an orifice 57 on a lower end for receiving fluids 59 from the ESP assembly 35. The body 53 also has a radial port 61 formed therethrough for allowing gases to enter an axial passage 63 that extends completely through the body 53.

Figure 2:
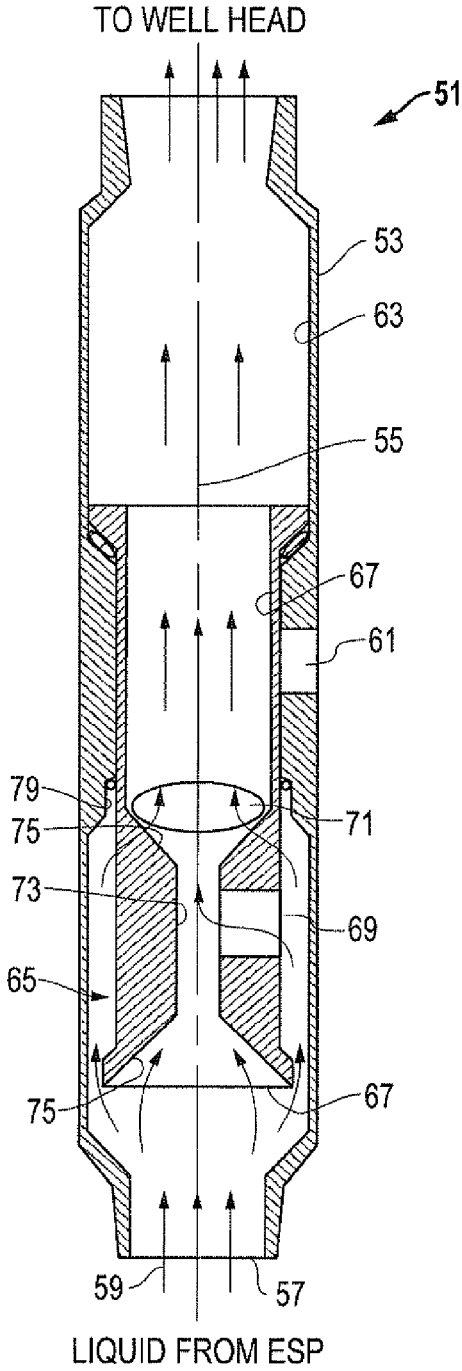
FIGS. 2 and 3 are schematic diagrams of an embodiment of a gas extracting device for the ESP assembly of FIG. 1, illustrating lower positions of an axially movable sleeve, and are constructed in accordance with the invention.

A sleeve 65 is coaxially mounted within the axial passage 63 of the body 53 for selective axial movement within the body. The sleeve 65 has an axial aperture 67 extending completely therethrough, and a radial aperture 69 in communication with the axial aperture 67. The sleeve 65 has a lower position (e.g., the lowest position is shown in FIG. 2) wherein fluids flow through the axial aperture 67 and the radial aperture 69 into the axial aperture 67. The sleeve 65 seals against the radial port 61 in the body 53 in the lower positions. An intermediate lower position is shown in FIG. 3.

Figure 4:
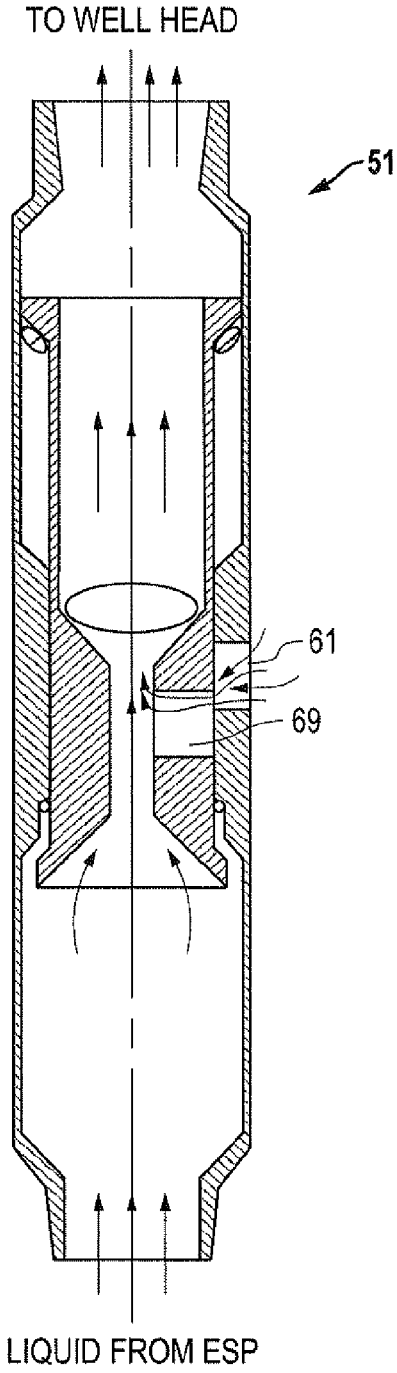
FIGS. 4 and 5 are schematic diagrams of the gas extracting device of FIGS. 2 and 3, illustrating upper positions of the axially movable sleeve, and are constructed in accordance with the invention.
Figure 5:
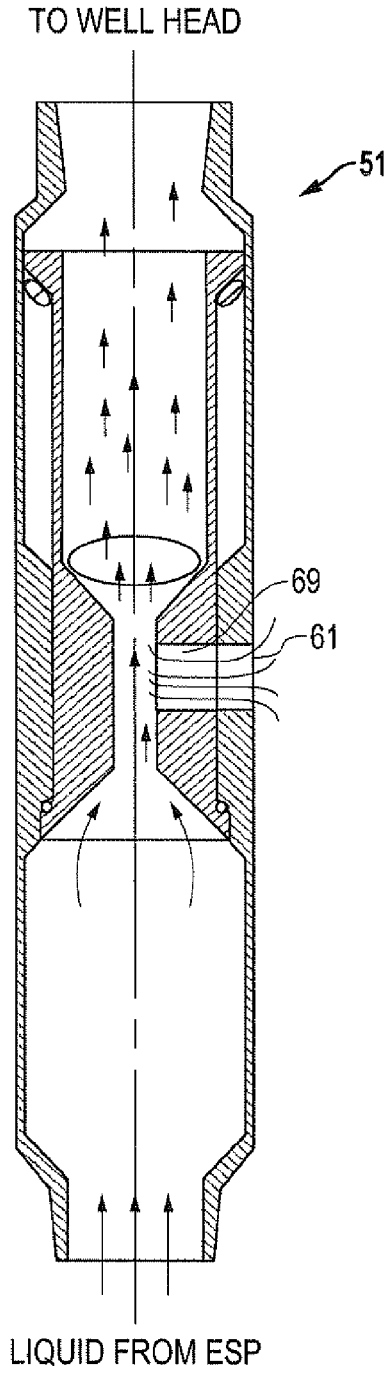
Figure 6:
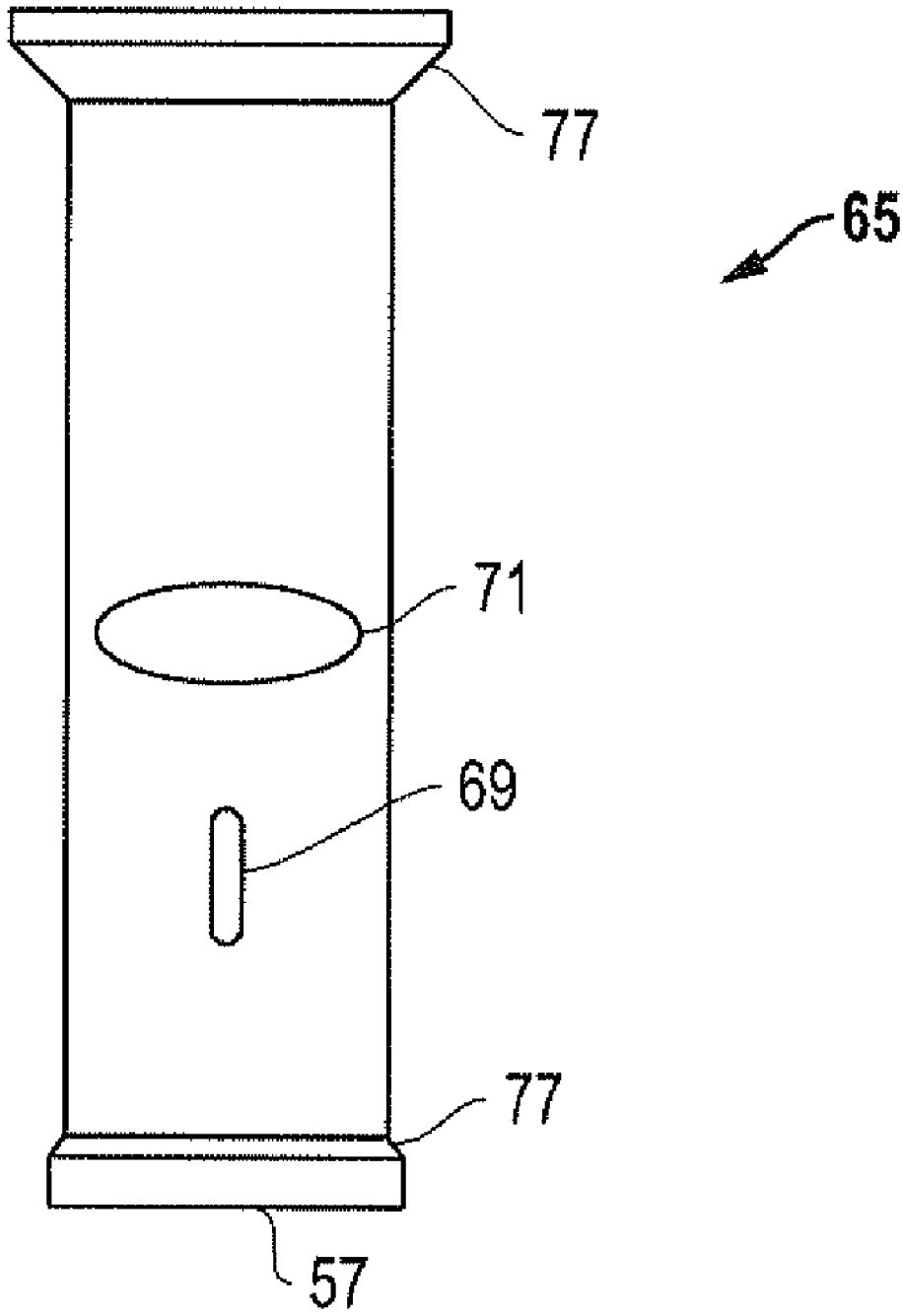
FIG. 6 is a side view of one embodiment of the axially movable sleeve for the gas extracting device of FIGS. 2-5 and is constructed in accordance with the invention.

FIGS. 4 and 5 depict upper positions (e.g., the uppermost position is shown in FIG. 6) for the sleeve 65. In the upper positions, the fluids 59 flow only through the axial aperture 57. The radial aperture 69 in the sleeve 65 at least partially aligns (see, e.g., FIG. 4) with the radial port 61 in the body 53 to draw gases into the fluids flowing through the axial aperture 67.

Figure 3:
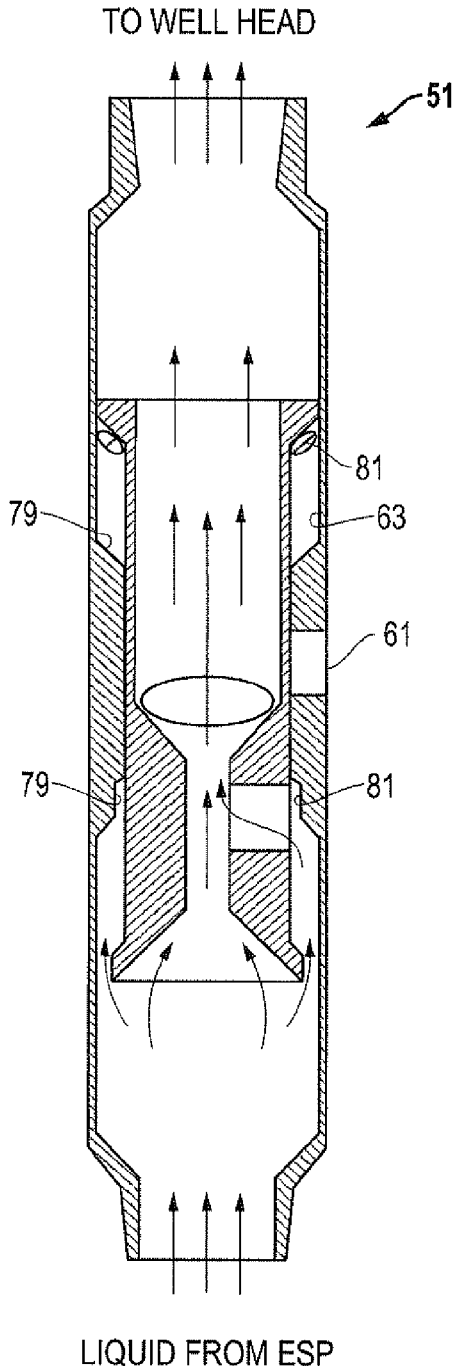

In other embodiments, the sleeve 65 may further comprise a radial opening 71 in communication with the axial aperture 67 in the sleeve for permitting additional fluids to flow into the sleeve when the sleeve is in the lower positions (FIGS. 2 and 3). The radial opening 71 is sealed between the sleeve 65 and the body 53 by seal 81 when the sleeve 65 is in the upper positions, as shown in FIGS. 4 and 5. FIG. 6 illustrates that the radial opening 71 may be provided with an oval shape. FIG. 6 also shows that the radial aperture 69 may be provided as an elongated slot formed in the sleeve 65 and is located below the radial opening 71.

The axial aperture 67 in the sleeve 65 may comprise a venturi having a throat 73 (FIG. 2) located between opposed divergent channels 75. The radial aperture 69 in the sleeve 65 intersects the throat 73 as shown. In addition, the radial opening 71 formed in the sleeve 65 and in communication with the axial aperture 67 for permitting additional fluids to flow into the sleeve when the sleeve is in the lower position, may be located above an upper one of the opposed divergent channels 75.

In the embodiments shown, the upper and lower ends 77 (FIG. 6) of the sleeve 65 are flared. The body 53 has the axial passage 63 through which the sleeve 65 slidingly extends. The axial passage 63 is tapered at both axial ends 79 and includes seals 81 for sealing against the flares 77 on the upper and lower ends of the sleeve 65. Engagement between the flares 77 and the tapers 79 limits axial travel of the sleeve 65 in both the uppermost (FIG. 5) and lowermost (FIG. 2) positions. As shown in FIG. 3, the radial port 61 in the body 53 intersects the axial passage 63 between the tapered axial ends 79.

Figure 7:
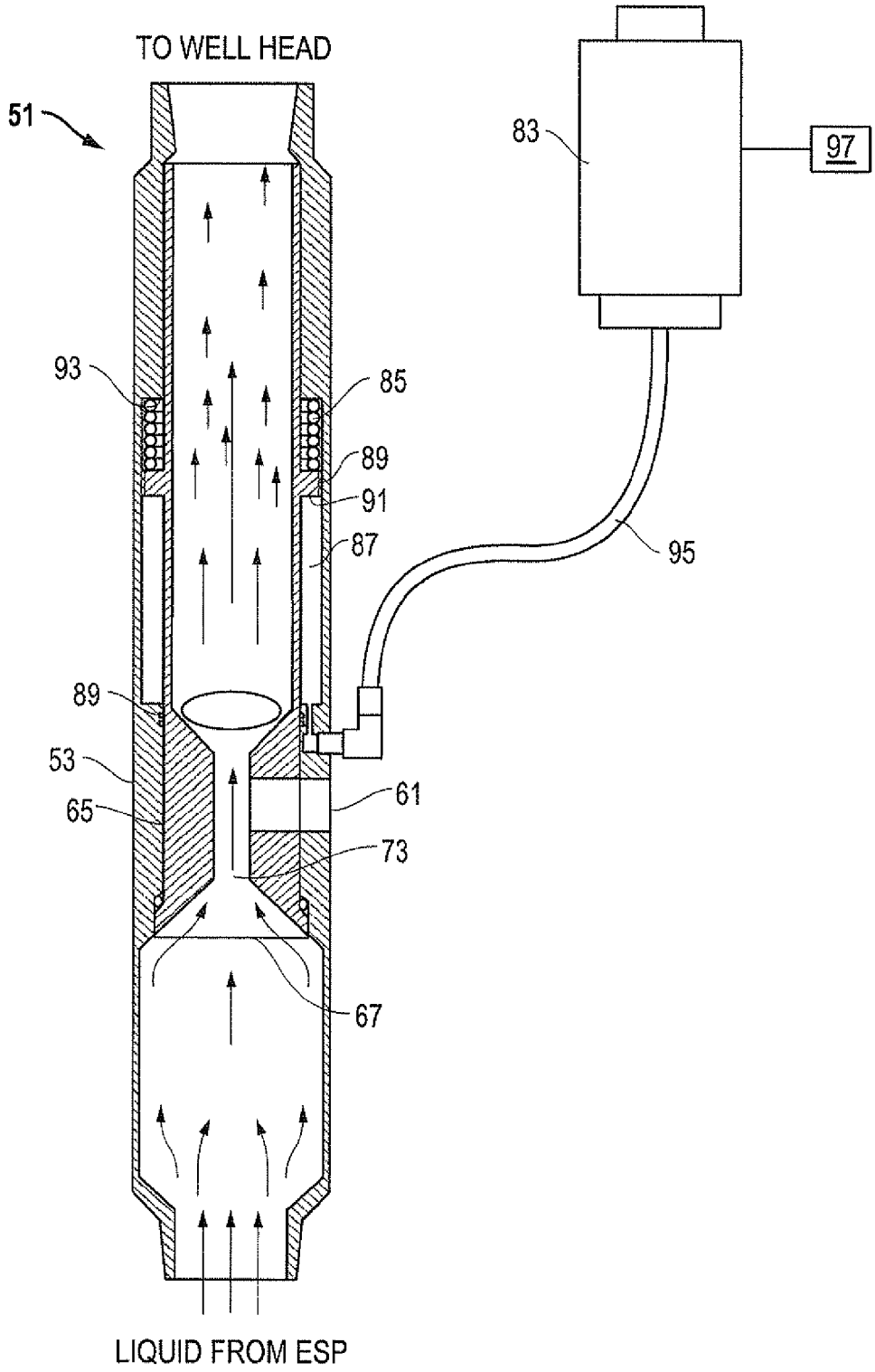
FIG. 7 is a schematic diagram of another embodiment of the gas extracting device of FIGS. 2-5, illustrating an upper position for the axially movable sleeve, and is constructed in accordance with the invention.
Figure 8:
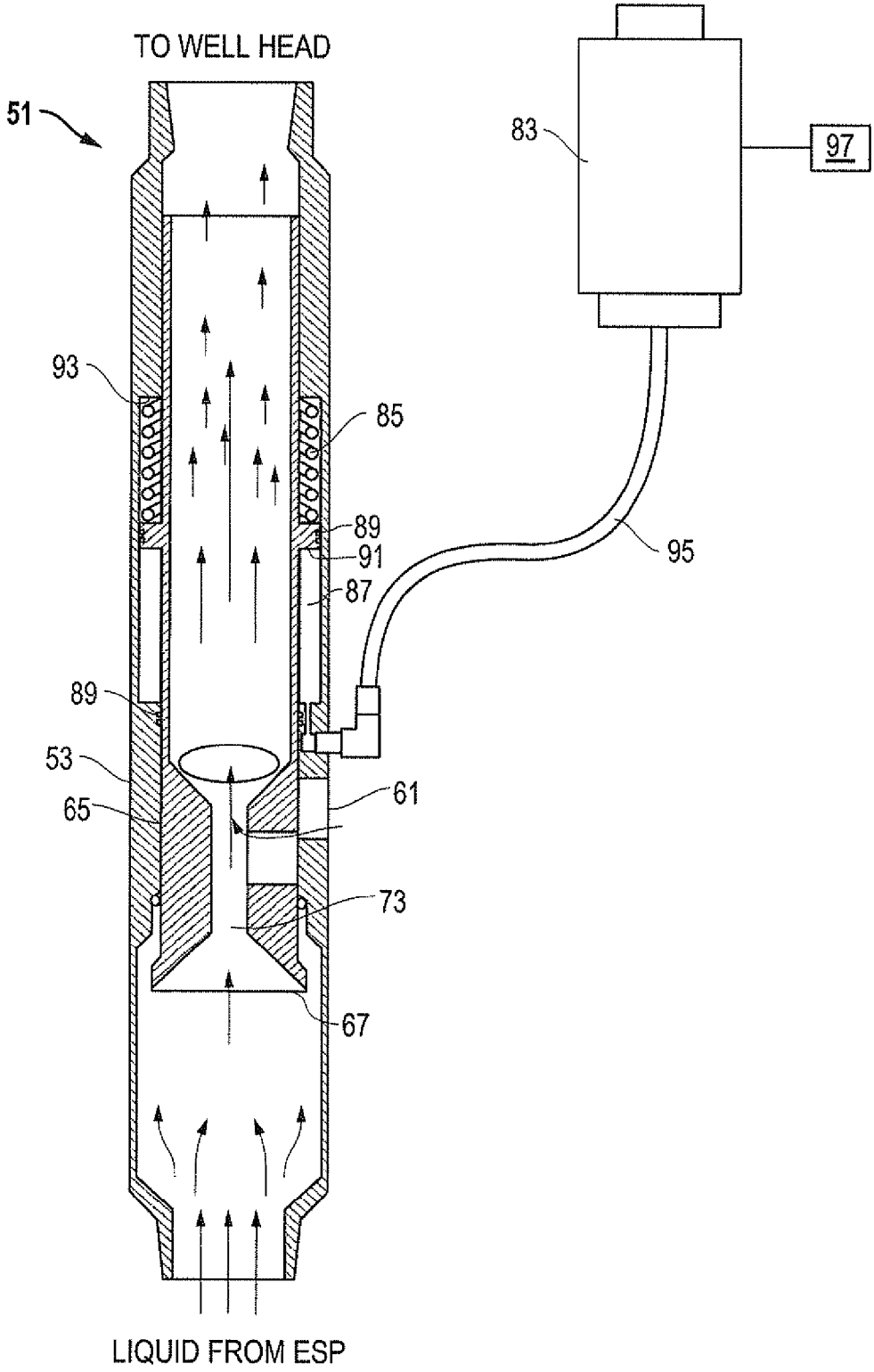
FIG. 8 is a schematic diagrams of the gas extracting device of FIG. 7, illustrating another, slightly lower position for the axially movable sleeve, and is constructed in accordance with the invention.
Figure 9:
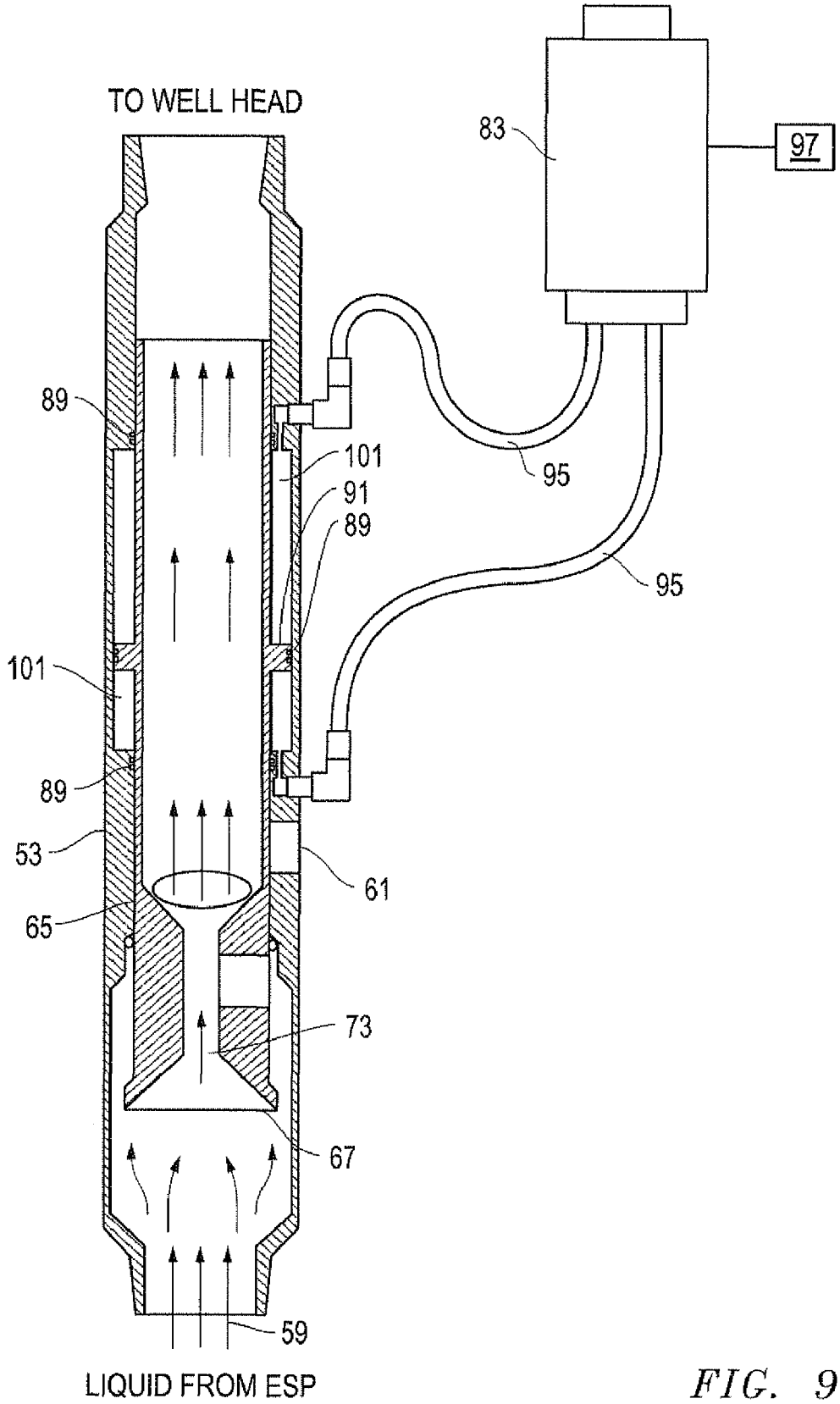
FIG. 9 is a schematic diagram of still another embodiment of the gas extracting device of FIGS. 2-5 and is constructed in accordance with the invention.

Referring now to FIGS. 7-9, the sliding sleeve 65 may be operated in a number of ways for the gas extracting device 51. FIGS. 7 and 8 illustrate how a hydraulic pump 83 compresses an opposing spring 85 to move the sliding sleeve 65 and allow gas to enter the jet pump. FIG. 9 shows the system operating only hydraulically to operate the sleeve 65.

Accordingly, the invention may further comprise a hydraulic chamber 87 (FIGS. 7 and 8) to be formed between the body 53 and the sleeve 65 in an annular space. The hydraulic chamber 87 is sealed at a lower end by seals 89 on an inner wall of the body 53 against the sleeve 65, and on an upper end by seals 89 on a flange 91 of the sleeve 65 that engage the inner wall of the body 53. The offset spring 85 extends between an upper surface of the flange 91 and a shoulder 93 formed in the body 53. The hydraulic pump 83 communicates hydraulic fluid to the hydraulic chamber 87 through a conduit 95 extending between the hydraulic chamber 87 and pump 83. Control means 97 selectively pressurizes the hydraulic chamber 87 such that the hydraulic pump 83 forces the sleeve 65 to the upper position (FIG. 7) and compress the offset spring 85 and, when pressure is reduced, the offset spring 85 biases the sleeve 65 to the lower positions (e.g., FIG. 8).

Referring again to FIG. 9, the system may comprise a pair of hydraulic chambers 101 (e.g., upper and lower chambers) that are formed between the body 53 and the sleeve 65 in the annular space. The upper and lower chambers 101 are separated by the flange 91 of the sleeve 65 that engages an inner wall of the body 53 with a seal 89. The upper and lower ends of the pair of hydraulic chambers 101 are sealed by seals 89 on the inner wall of the body 53 against outer surfaces of the sleeve 65. The hydraulic pump 83 communicates hydraulic fluid to the pair of hydraulic chambers 101 through separate conduits 95 extending between the pair of hydraulic chambers 101 and the hydraulic pump 83. The control means 97 selectively pressurizes the pair of hydraulic chambers 101 to selectively force the sleeve 65 between the upper and lower positions as described herein.

While the invention has been shown or described in only some of its forms, it should be apparent to those skilled in the art that it is not so limited, but is susceptible to various changes without departing from the scope of the invention.

We claim:

1. A fluid production system, comprising:

a production vessel in fluid communication with oil and gas;

an electrical submersible pump (ESP) assembly installed in the production vessel for pumping oil out of the production vessel; the ESP assembly comprising:

a motor, a seal section and a pump having a fluid intake;

a gas extraction device adjacent the ESP assembly and having a body with an axis and an orifice for receiving fluids from the ESP assembly, and a radial port formed in the body;

a sleeve coaxially mounted within the body for selective axial movement within the body, the sleeve having an axial aperture extending therethrough, and a radial aperture in communication with the axial aperture, the sleeve having a lower position wherein fluids flow through the axial aperture and the sleeve seals against the radial port in the body, and an upper position wherein the fluids flow through the axial aperture, and the radial aperture in the sleeve at least partially aligns with the radial port in the body to draw gas into the fluids flowing through the axial aperture; wherein the axial aperture comprises a venturi having a throat located between opposed divergent channels, and the radial aperture in the sleeve intersects the throat.

2. A fluid production system according to claim 1, thither comprising a radial opening formed in the sleeve and in communication with the axial aperture in the sleeve for permitting additional fluids to flow into the sleeve when the sleeve is in the lower position.

3. A fluid production system according to claim 2, wherein the radial opening is sealed between the sleeve and the body when the sleeve is in the upper position.

4. A fluid production system according to claim 3 wherein the radial opening has an oval shape.

5. A fluid production system according to claim 2, wherein the radial aperture is an elongated slot formed in the sleeve and is located below the radial opening.

6. A fluid production system according to claim 1, further comprising a radial opening formed in the sleeve and in communication with the axial aperture in the sleeve for permitting additional fluids to flow into the sleeve when the sleeve is in the lower position, the radial opening being located above an upper one of the opposed divergent channels.

7. A fluid production system according to claim 1, wherein upper and lower ends of the sleeve are flared, and the body has an axial passage through which the sleeve slidingly extends, and the axial passage is tapered at both axial ends and includes seals for sealing against the flares on the upper and lower ends of the sleeve, such that engagement between the flares and tapers limits axial travel of the sleeve in both the upper and lower positions.

8. A fluid production system according to claim 7, wherein the radial port in the body intersects the axial passage between the tapered axial ends.

9. A fluid production system according to claim 1, further comprising:

a hydraulic chamber is formed between the body and the sleeve in an annular space and is sealed at a lower end by seals on an inner wall of the body against the sleeve, and on an upper end by seals on a flange of the sleeve that engage the inner wall of the body, an offset spring extending between an upper surface of the flange and a shoulder formed in the body;

a hydraulic pump for communicating hydraulic fluid to the hydraulic chamber, a conduit extending between the hydraulic chamber and pump, and control means for selectively pressurizing the hydraulic chamber, such that the hydraulic pump pressurizes the hydraulic chamber to force the sleeve to the upper position and compress the offset spring and, when pressure is reduced, the offset spring biases the sleeve to the lower position.

10. A fluid production system according to claim 1, further comprising:

a pair of hydraulic chambers are formed between the body and the sleeve in an annular space, separated by a flange of the sleeve that engages an inner wall of the body with a seal, wherein upper and lower ends of the pair of hydraulic chambers are sealed by seals on the inner wall of the body against outer surfaces of the sleeve;

a hydraulic pump for communicating hydraulic fluid to the pair of hydraulic, chambers, conduits extending between the pair of hydraulic chambers and the hydraulic pump, and control means for selectively pressurizing the pair of hydraulic chambers, such that the hydraulic pump pressurizes the pair of hydraulic chambers to selectively force the sleeve between the upper and lower positions.

11. A fluid production system according to claim 1, further comprising a sensor for sensing a property of the fluid that indicates a relative proportion of gas in the oil; and a controller for controlling a flow rate of the pump in response to the property sensed by the sensor.

12. A fluid production system, comprising:

a production vessel in fluid communication with oil and gas;

an electrical submersible pump (ESP) assembly installed in the production vessel for pumping oil out of the production vessel; the ESP assembly comprising:

a motor, a seal section and a pump having a fluid intake;

extraction device mounted the ESP assembly and having a body with an axis and an orifice on a lower end for receiving fluids from the ESP assembly, and a radial port formed the body;

a sleeve coaxially mounted within the body for selective axial movement within the body, the sleeve having an axial aperture extending therethrough, and a radial aperture in communication with the axial aperture, the sleeve having a lower position wherein fluids flow through the axial aperture and the radial aperture into the axial aperture and the sleeve seals against the radial port in the body, and an upper position wherein the fluids flow only through the axial aperture, and the radial aperture in the sleeve at least partially aligns with the radial port in the body to draw gas into the fluids flowing through the axial aperture; and a radial opening formed in the sleeve and in communication with the axial aperture in the sleeve for permitting additional fluids to flow into the sleeve when the sleeve is in the lower position.

13. A fluid production system according to claim 12, wherein the radial opening is sealed between the sleeve and the body when the sleeve is in the upper position, and the radial opening has an oval shape.

14. A fluid production system according to claim 12, wherein the radial aperture is an elongated slot formed in the sleeve and is located below the radial opening.

15. A fluid production system according to claim 12, wherein the axial aperture comprises a venturi having a throat located between opposed divergent channels, and the radial aperture in the sleeve intersects the throat; and further comprising:

a radial opening formed in the sleeve and in communication with the axial aperture in the sleeve for permitting additional fluids to flow into the sleeve when the sleeve is in the lower position, the radial opening being located above an upper one of the opposed divergent channels.

16. A fluid production system according to claim 12, wherein upper and lower ends of the sleeve are flared, and the body has an axial passage through which the sleeve slidingly extends, and the axial passage is tapered at both axial ends and includes seals for sealing against the flares on the upper and lower ends of the sleeve, such that engagement between the flares and tapers limits axial travel of the sleeve in both the upper and lower positions, and wherein the radial port in the body intersects the axial passage between the tapered axial ends.

17. A fluid production system according to claim 12, further comprising:

a hydraulic chamber is formed between the body and the sleeve in an annular space and is sealed at a lower end by seals on an inner wall of the body against the sleeve, and on an upper end by seals on a flange of the sleeve that engage the inner wall of the body, an offset spring extending between an upper surface of the flange and a shoulder formed in the body;

a hydraulic pump for communicating hydraulic fluid to the hydraulic chamber, a conduit extending between the hydraulic chamber and pump, and control means for selectively pressurizing the hydraulic chamber, such that the hydraulic pump pressurizes the hydraulic chamber to force the sleeve to the upper position and compress the offset spring and, when pressure is reduced, the offset spring biases the sleeve to the lower position.

18. A fluid production system according to claim 12, further comprising:

a pair of hydraulic chambers are formed between the body and the sleeve in an annular space, separated by a flange of the sleeve that engages an inner wall of the body with a seal, wherein upper and lower ends of the pair of hydraulic chambers are sealed by seals on the inner wall of the body against outer surfaces of the sleeve;

a hydraulic pump for communicating hydraulic fluid to the pair of hydraulic chambers, conduits extending between the pair of hydraulic chambers and the hydraulic pump, and control means for selectively pressurizing the pair of hydraulic chambers, such that the hydraulic pump pressurizes the pair of hydraulic chambers to selectively force the sleeve between the upper and lower positions.

19. A fluid production system according to claim 12, further comprising a sensor for sensing a property of the fluid that indicates a relative proportion of gas in the oil; and a controller for controlling a flow rate of the pump in response to the property sensed by the sensor.

* * * * *

UNITED STATES PATENT AND TRADEMARK OFFICE

CERTIFICATE OF CORRECTION

PATENT NO. : 7,984,766 B2
APPLICATION NO. : 12/261104
DATED : July 26, 2011
INVENTOR(S) : Donn J. Brown It is certified that error appears in the above-identified patent and that said Letters Patent is hereby corrected as shown below:

IN THE CLAIMS:

Column 5, line 63, delete “thither” and insert -- further --

Signed and Sealed this
Twenty-ninth Day of November, 2011

David J. Kappos

David J. Kappos
*Director of the United States Patent and Trademark Office*